US007383806B2

(12) United States Patent
Abi-Akar et al.

(10) Patent No.: US 7,383,806 B2
(45) Date of Patent: Jun. 10, 2008

(54) ENGINE WITH CARBON DEPOSIT RESISTANT COMPONENT

(75) Inventors: Hind Abi-Akar, Peoria, IL (US); Xiangyang Jiang, Dunlap, IL (US); Jorge R. Agama, Peoria, IL (US); Kurtis C. Kelley, Washington, IL (US); Mark W. Jarrett, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 157 days.

(21) Appl. No.: 11/131,743

(22) Filed: May 18, 2005

(65) Prior Publication Data

US 2006/0260583 A1 Nov. 23, 2006

(51) Int. Cl.
*F01L 1/14* (2006.01)

(52) U.S. Cl. ..... 123/193.6; 123/668

(58) Field of Classification Search ..... 428/544, 428/612, 627, 652, 680; 427/438, 442.1; 123/193.6, 668

See application file for complete search history.

(56) References Cited

U.S. PATENT DOCUMENTS

| | | | | |
|---|---|---|---|---|
| 2,926,649 | A * | 3/1960 | Hicks | 123/668 |
| 3,592,370 | A | 7/1971 | Briggs | |
| 4,577,549 | A | 3/1986 | Frank et al. | |
| 4,666,788 | A | 5/1987 | Yano et al. | |
| 4,673,468 | A | 6/1987 | Myers et al. | |
| 4,695,229 | A * | 9/1987 | Feuling | 416/241 A |
| 4,753,724 | A * | 6/1988 | Womble | 210/180 |
| 5,195,478 | A | 3/1993 | Kawabata et al. | |
| 5,244,368 | A | 9/1993 | Frushour | |
| 5,266,142 | A | 11/1993 | Penrice | |
| 5,441,024 | A | 8/1995 | Wietig et al. | |
| 5,713,324 | A | 2/1998 | Frame et al. | |
| 5,755,100 | A | 5/1998 | Lamos | |
| 5,771,873 | A * | 6/1998 | Potter et al. | 123/668 |
| 6,146,702 | A | 11/2000 | Zitko | |
| 6,841,264 | B2 * | 1/2005 | Lunnerfjord et al. | 428/679 |
| 6,866,031 | B2 * | 3/2005 | Spiegel et al. | 123/668 |
| 2003/0098145 | A1 | 5/2003 | Kiyoshi et al. | |

FOREIGN PATENT DOCUMENTS

| | | | |
|---|---|---|---|
| DE | 3503859 A | * | 9/1985 |
| EP | 2005201099 | * | 7/2005 |
| FR | 1593248 A | | 5/1970 |

(Continued)

OTHER PUBLICATIONS

Patent Abstracts of JA 022010694 of Aug. 9, 1990, Mazda Motor Corp.

(Continued)

*Primary Examiner*—M. McMahon
(74) *Attorney, Agent, or Firm*—Liell + McNeil

(57) ABSTRACT

Carbon deposits on engine components can negatively affect engine performance. An engine of the present disclosure includes at least one carbon deposit resistant engine component attached to an engine housing. The engine component includes at least one relatively high surface tension surface that is a non-contact wear surface and to which a relatively low surface tension coating is attached. The relatively low surface tension coating has a surface tension at least one of equal to and less than 30 dyne/cm.

17 Claims, 3 Drawing Sheets

FOREIGN PATENT DOCUMENTS

| | | |
|---|---|---|
| JP | 5-163580 A | 6/1993 |
| JP | 5-163581 | 6/1993 |
| JP | 6-300129 | 10/1994 |

OTHER PUBLICATIONS

Patent Abstracts of JA 02173472 of Jul. 4, 1990, Toyota Motor Corp.
Patent Abstracts of JA 01237310 of Sep. 21, 1989, Taiho Kogyo Cot. Ltd.
Patent Abstracts of JA 2005201099 of Jul. 28, 2005, Acro Nainen Co. Ltd.
Abstracts/JSAE Review 17 9539716 Development of Low-Friction Solid Lubricant Film Coated Piston; (1996) p. 92.
J.K. Dennis and T.E. Such; Nickel and Chromium Plating Third Edition; 1993; p. 326; Woodhead Publishing Limited; Cambridge England.
Wolfgang Riedel, Electroless Nickel Plating; 1991; pp. 251 and 263; Finshing Publications Ltd and ASM International; Melksham, Wiltshire.

* cited by examiner

ENGINE WITH CARBON DEPOSIT RESISTANT COMPONENT

TECHNICAL FIELD

The present disclosure relates generally to internal combustion engines, and more specifically to a method of reducing carbon deposits on engine components of internal combustion engines.

BACKGROUND

It is known that oil deterioration and the combustion process within internal combustion engines can create the accumulation of carbon deposits, sometimes referred to as carbon packing, on surfaces of engine components, and negatively affect the performance of the component and engine. In fact, carbon packing on engine components can decrease fuel economy, increase undesirable emissions, and eventually lead to a loss in engine power. Specifically, carbon packing can occur on ring grooves defined by an engine piston and in which rings are positioned to seal the space between an annular side surface of the piston and a cylinder liner. The carbon packing on the ring grooves can alter the position of the rings, increasing the tension between the liner and the rings. In extreme cases, the piston can become stuck, potentially causing catastrophic engine failure.

Moreover, carbon packing on the annular surface of the engine piston can make contact with the cylinder liner. As the piston reciprocates, the rings seal the combustion area, during combustion, at the piston-liner area. Further, the rings move oil from the crankcase to the top of the piston-liner area, creating a thin surface of oil to lubricate the liner-ring motion. Carbon packing in the piston-liner area causes more oil to be moved into the combustion chamber than desired. The excess oil interferes with the combustion of the fuel, resulting in decreased fuel efficiency. Further, the excess oil in the combustion chamber contributes to even more carbon packing and to undesirable emissions.

Carbon deposits caused by oil can occur in engine components other than pistons. For instance, an oil cooler includes a bundle of tubes through which coolant passes. As heated oil passes over the tubes, the heated oil can form deposits that adhere to the coolant tubes. The deposits can decrease the life the of the tubes, and decrease the thermal transfer efficiency between the coolant and the passing oil.

Over the years, engineers have sought methods of limiting carbon packing and deposits without making major alterations to the engine. For instance, carbon-resistant coatings, such as the coating described in U.S. Pat. No. 5,771,873, issued to Potter et al., on Jun. 30, 1998, have been applied to surfaces of engine components adjacent to and/or within the combustion chamber. The Potter carbon-resistant coating is an amorphous hydrogenated carbon film coating that is believed to prevent carbon packing because the coating is supposedly chemically inert with respect to deposit formation chemistry. The amorphous hydrogenated carbon film coating is illustrated for use on surfaces of intake valve, exhaust valves, fuel injectors and pistons which are exposed to the combustion chamber. However, the amorphous hydrogenated carbon film coating is fragile, and may not be able to withstand the limited movement, or lashing, of the piston rings against the annular sides surface of the piston as the piston reciprocates. Thus, the amorphous hydrogenated carbon film coating is not suitable for certain engine components, such as the annular surface of the piston.

The present disclosure is directed at overcoming one or more of the problems set forth above.

SUMMARY OF THE DISCLOSURE

In one aspect of the present disclosure, an engine, with at least one carbon deposit resistant component, includes at least one engine component attached to or positioned within the engine housing. The engine component includes at least one relatively high surface tension surface that is a non-contact wear surface and to which a relatively low surface tension coating is attached. The relatively low surface tension coating includes a surface tension that is at least one of equal to and less than 30 dyne/cm.

In another aspect of the present disclosure, carbon deposits on at least one non-contact wear surface of an engine component are reduced by coating at least one relatively high surface tension surface of the engine component with a relatively low surface tension material. The relatively low surface tension material includes a surface tension that is at least one of equal to and less than 30 dyne/cm.

In yet another aspect of the present disclosure, a carbon deposit resistant engine piston includes a piston body that includes at least one relatively high surface tension surface. The relatively high surface tension surface is a non-contact wear surface to which a relatively low surface tension coating that includes a surface tension that is at least one of equal to and less than 30 dyne/cm is attached.

DETAILED DESCRIPTION

Figure 1:
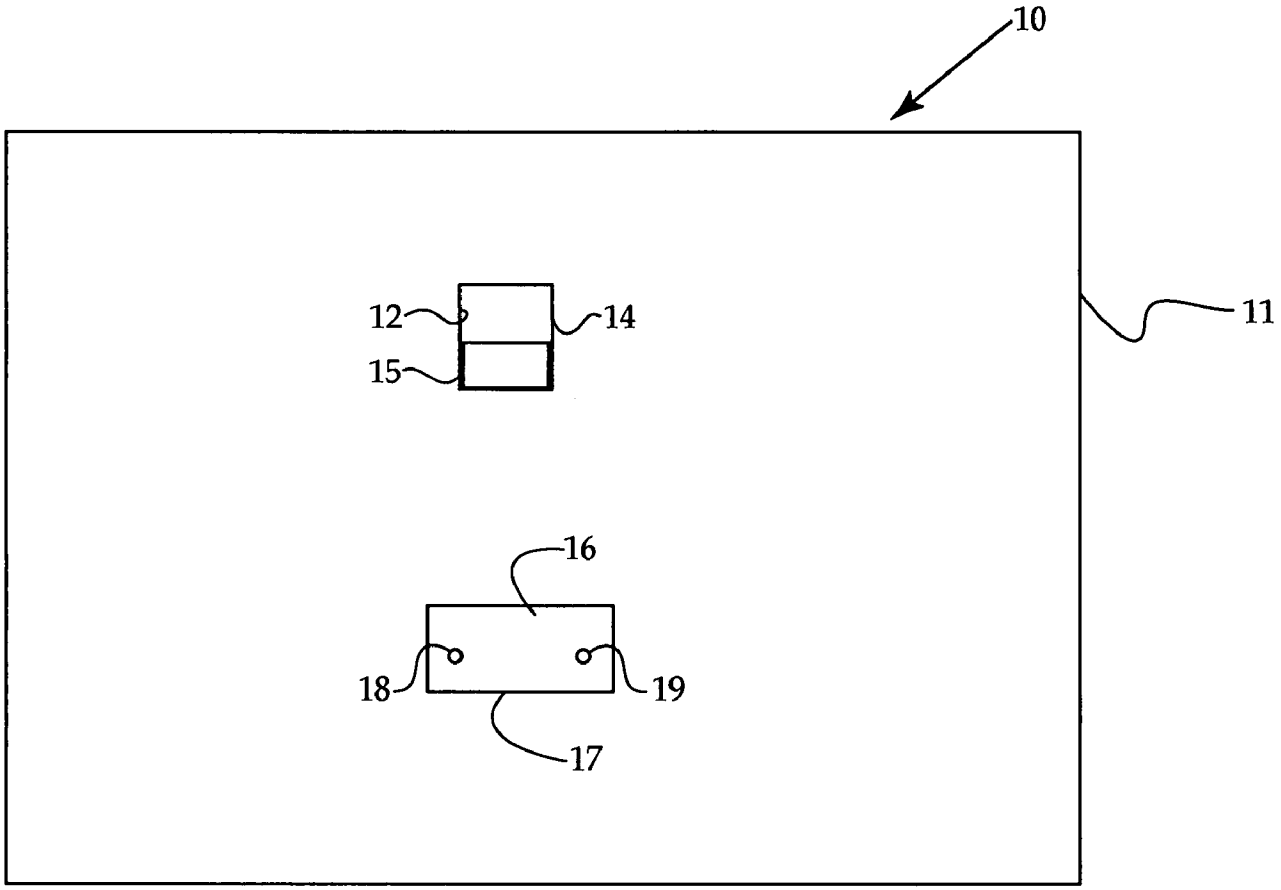
FIG. 1 is a schematic representation of a an engine, according to the present disclosure.

Referring to FIG. 1, there is shown a schematic representation of an engine 10, according to the present disclosure. The engine 10 includes an engine housing 11 to which at least two carbon resistant engine components are attached or positioned. Although the carbon resistant engine components are preferably an engine piston 15 and and/or oil cooler 16 that includes at least one coolant tube (shown in FIG. 3), it should be appreciated that the present disclosure contemplates an engine with various other carbon resistant engine components, including any suitable non-wear surface.

The engine housing 11 defines at least one engine cylinder 14 in which at least one combustion chamber 12 is disposed. The engine piston 15 that is operably connected to a crank shaft (not shown) and is moveable between a bottom dead center position and a top dead center position in the engine cylinder 14. An oil cooler 16 is attached to the engine housing 11. The oil cooler 16 includes a cooler housing 17 that defines an oil inlet 18 and an oil outlet 19. The oil flowing through the oil cooler 16 passes over an outer surface of a plurality of coolant tubes, which are often copper, (shown in FIG. 3) through which coolant passes. The coolant absorbs the heat from the oil. Thus, the oil exiting the outlet 19 is cooler than the oil entering the inlet 18.

Figure 2:
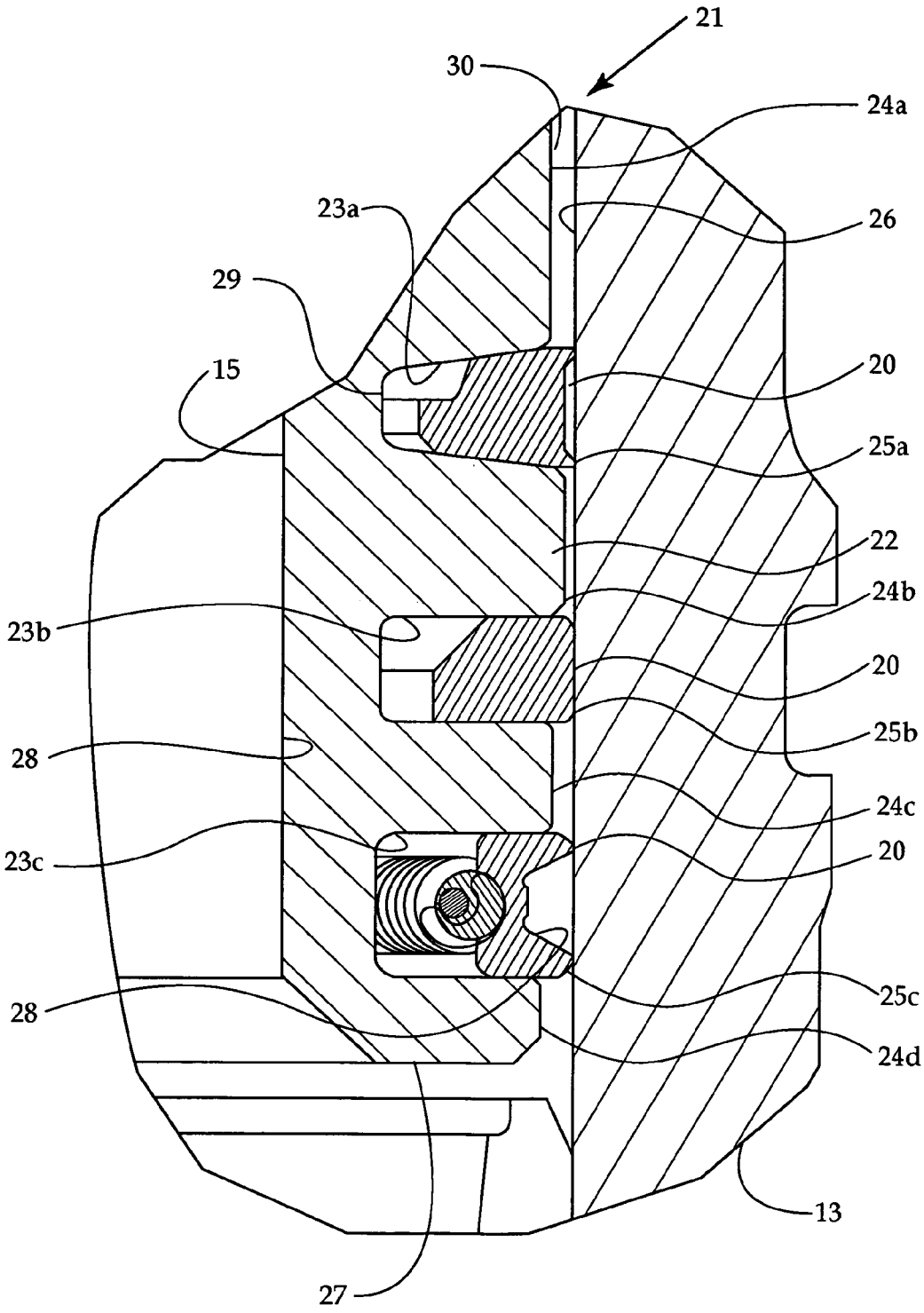
FIG. 2 is a partial sectioned diagrammatic view of a piston within a cylinder of the engine of FIG. 1.

Referring to FIG. 2, there is shown a partial sectioned diagrammatic view of the piston 15 within the engine cylinder 14 of the engine 10 of FIG. 1. FIG. 2 is an enlargement of a piston-liner area 21 of the engine cylinder 14. Preferably, an engine cylinder liner 13 is positioned between the engine housing 11 defining the cylinder 14 and the piston 15, and includes an annular inner surface 26. The piston 15 includes a body 29 that includes at least one relatively high surface tension surface, preferably being an annular side surface 22. The term "surface tension" is sometimes referred to, especially in the case of solids, as "surface energy". and is expressed as units of force per unit of length. such as dyne/cm. Thus, as used in this patent application the terms are interchangeable. The piston body 29 may be comprised of various materials, such as a known steel alloy. Those skilled in the art will recognize that the steel and/or iron components used in engine construction have high surface tensions, typically much greater than 1000 dyne/cm. The body 29 defines, in part, a cavity 28 in which oil can flow, and separates a top surface (not shown) that defines, in part, the combustion chamber 12 (shown in FIG. 1) from a bottom surface 27 of the piston 15. In the illustrated embodiment, the oil that flows from an oil reservoir into the cavity 28 and the piston-liner area 21.

The annular side surface 22 defines a plurality of annular grooves 23 that includes a first groove 23*a*, a second groove 23*b* and a third groove 23*c*. A first, second and third rings 25*a*, 25*b* and 25*c* are positioned within the first, second and third grooves 23*a*, 23*b* and 23*c*, respectively. An outer surface 20 of each ring 25*a-c* is in contact with the inner surface 26 of the liner 13. Thus, the outer surfaces 20 of the rings 25*a-c* and the inner surface 26 of the liner 13 are contact wear surfaces. Those skilled in the art will appreciate that the tension between the liner 13 and the rings 25*a-c* is designed such that the piston 15 can move between the top dead center position and the bottom dead center position as desired and such that the rings can provide an efficient seal for the combustion chamber 12. As the piston 15 moves from the bottom dead center position to the top dead center position, the rings 25*a-c* will move the oil from the piston-liner area 21 adjacent to the bottom surface 27 to the piston-liner are 21 adjacent to the top surface, creating a thin layer of oil that acts as lubrication for the rings 25*a-c* and liner 13 contact. Those skilled in the art will appreciate that the three rings 25*a-c* may have different shapes, and together seal the piston-liner area 21 from the combustion chamber 12, conduct heat from the piston 15 to the liner 13 and maintain oil lubrication in the piston-liner area 21. The third ring 25*c* is illustrated as defining an opening 28 through which oil can flow back to the reservoir.

The annular side surface 22 of the piston 15 also includes a plurality of lands 24*a-d* that separate the rings 25*a-c* from one another and the top and bottom surface 27 of the piston 15. The lands 24*a-d* do not make contact with the inner surface 26 of the liner 13. Thus, the lands 24*a-d* and the annular groves 23*a-c* are non-contact wear surfaces.

A relatively low surface tension coating 30 that includes a surface tension that is equal to or less than 30 dyne/cm is adhered to the annular side surface 22. Although the coating 30 is preferably adhered to the annular side surface 22 of the piston 15, it should be appreciated that the present disclosure contemplates the coating 30 being attached to any engine component that could be subjected to carbon deposits. Thus, the coating 30 is applicable to any non-contact wear surface of an engine component that is not subjected to temperatures at which the carbon is combusted. Although the coating 30 can include various material having a surface tension equal to or less than 30 dyne/cm, such as nickel-phosphorous, the relatively low surface tension coating 30 preferably includes nickel polytetrafluoroethylene (PTFE). The nickel forms a metallic matrix in which the polytetrafluoroethylene is dispersed. The nickel matrix provides structural integrity to the coating 30, while the polytetrafluoroethylene imparts its low surface tension. Those skilled in the art appreciate that polytetrafluoroethylene (PTFE) and that any various other compounds from the "Teflon" family, including, but not limited to, PTFE, FEP, PFA and ETFE, can be deposited within the nickel matrix and used to impart their low surface tension to the coating 30. PTFE has a surface tension of 18 dyne/cm, and all members of the "Teflon" family include surface tensions between 16-22 dyne/cm. Those skilled in the art will also appreciate that the nickel matrix will have a higher surface tension than the PTFE. Thus, the surface tension of the coating 30 will vary depending on the amount of nickel within the coating 30, but in all embodiments, will have a surface tension less than 30 dynes/cm. Because carbon has a surface tension of approximately 40-56 dyne/cm, the coating 30 will repel, rather than attract, the carbon deposits.

Preferably, the coating 30 includes electroless nickel phosphorous-PTFE. Although an electroless nickel bath is the preferred method of applying the coating 30 to the piston 15, the present disclosure contemplates other methods, such as an electrolytic plating bath. Although the amount of PTFE that can be deposited within the nickel can range from 10-33% of the electroless nickel phosphorous-PTFE by volume, preferably the electroless nickel phosphorous-PTFE includes 18-28% PTFE, by volume. Those skilled in the art will appreciate that the percentage of PTFE can vary between 18-28% throughout the coating 30 due to the electroless bath process, and that the 10% range represents the typical state of art accuracy for an electroless bath process. The 18-28% range sufficiently imparts the surface tension of the PTFE in order to repel carbon deposits while maintaining the structural integrity of the nickel matrix in the coating 30.

Although those skilled in the art will appreciate that the coating 30 of nickel-PTFE can be as thick as 25 microns, coatings of nickel-PTFE are generally between 5 to 15 microns thick. In the preferred embodiment of the present disclosure, the coating 30 on the piston 15 is between 5-7 microns thick which does not require pre- or post-assembly changes to the geometry of the piston 15. At this preferred thickness, the coating 30 does not interfere with the cooling of the piston 15.

Figure 3:
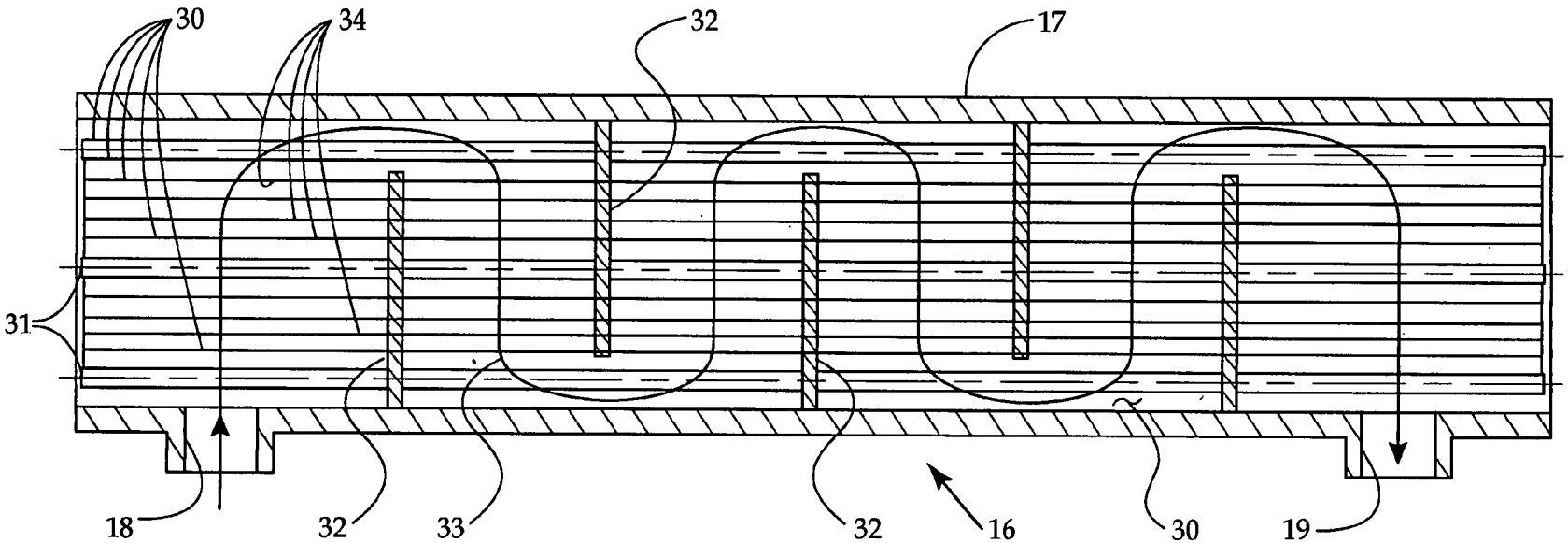
FIG. 3 is a front sectioned diagrammatic view of an oil cooler for the engine of FIG. 1.

Referring to FIG. 3, there is shown a front sectioned diagrammatic view of the oil cooler 16 of the engine 10 of FIG. 1. The plurality of tubes 31 are mounted to the oil cooler housing 17 in a conventional manner. Those skilled in the art will appreciate that there can be various number of coolant tubes 31 made of various materials. However, in the illustrated example, the coolant tubes 31 are made from cooper which has a high surface tension, approximately 1830 dyne/cm. The tubes 31 are mounted to baffles 32 that extend partially through the cross-section of the plurality of tubes 31. Although there may be various number of baffles 32, the oil cooler 16 is illustrated as including five. When the plurality of tubes 31 are mounted in the housing 17, a serpentine oil flow path 33 around the baffles 32 and over the tubes 31 begins at inlet 18 and ends at outlet 19. Each coolant tube 31 includes a relatively high surface tension surface, being an outer surface 34 that tubes 31. In the illustrated example the outer surface 34 includes cooper. The relatively low surface tension coating 30 is attached to the outer surfaces 34 of the tubes 31. Those skilled in the art will appreciate that the thickness of the coating 30 may differ between application on the piston 15 and on the coolant tubes 31, so as not to undermine heat transfer. Although the coating 30 is generally applied to be between 5 to 15 microns thick, the coating 30 applied to the tubes 30 should be sufficiently think to repel carbon deposits while not affecting the geometry or operation of the oil cooler 16.

INDUSTRIAL APPLICABILITY

Referring to FIGS. 1-3, a method of reducing carbon deposits on the engine components 15, 16 of the internal combustion engine 10 will be discussed. Although the method will be discussed for the non-contact wear surfaces 22 and 34 of the engine piston 15 and the oil cooler 16, respectively, it should be appreciate that the present disclosure can operate to reduce carbon deposits similarly for any engine component subjected to carbon deposits. Engine components that include surfaces that are non-contact wear surfaces and are not subjected to temperatures sufficiently high to burn the carbon can be subjected to carbon deposits. Carbon deposits on the non-contact wear surface, being the annular surface 22, of the engine piston 15 are reduced by coating the annular surface 22 with the relatively low surface tension material, preferably nickel-PTFE. Although the PTFE imparts its relatively low surface tension, 18 dyne/cm, to the coating 30, the nickel matrix provides structural integrity to the coating 30 so the coating 30 may withstand the conditions within the engine cylinder 14 caused by the movement of the piston 15 and the fuel combustion. The nickel, being thermally conductive, does not degrade the cooling process of the piston 15.

In order to coat the annular surface of the piston 15, the coating 30 is preferably applied to a total surface of the piston 15, including the surface of the rings 25*a-c*. The entire piston is placed into an electroless nickel bath of the type known in the art. A rack process is preferred in order to ensure that the piston lands 24*a-d* and grooves 23*a-c* are adequately covered with the coating 30. Electroless nickel plating is based upon the catalytic reduction of nickel ions on the surface being plated, and does not require an external current source. Those skilled in the art will appreciate that the bath chemistry, such as the temperature, the pH, and the surfactants, needed to properly suspend in the electroless bath and co-deposit into the nickel matrix PTFE and phosphorous is known in the art. Preferably, a phosphorous concentration that is co-deposited with the PTFE is between 7-10%. However, if the relatively low surface tension coating 30 includes electroless-nickel phosphorous rather than electroless nickel phosphorous PTFE, the electroless-nickel phosphorous can include up to 13% phosphorous.

Although the electroless-nickel bath is the preferred method of coating the piston 15, the nickel-PTFE can also be applied to the piston 15 by an electrolytic process that is known in the art. The electrolytic process uses electric current to reduce nickel salts in the electrolytic plating bath into nickel metal that deposits on the surface to be coated. PTFE can be co-deposited on the piston 15 along with the nickel. Although the electrolytic plating bath is an alternative to the electroless nickel bath, the electroless process is preferred. The electroless nickel-phosphorous PTFE is amorphous, whereas the nickel-PTFE has a crystalline structure. The amorphous electroless nickel-phosphorous PTFE is preferred because it is more inert than the crystalline nickel-PTFE. Further, the electroless nickel-phosphorous PTFE includes phosphorous that induces the amorphous character of the electroless nickel and can enhance the ability of the coating 30 to resist carbon deposits. In addition, the electroless disposition of the coating 30 does not require an external electric current. Because the electroless nickel-phosphorous PTFE coating 30 on the piston 15 is preferably 5-7 micron thick, no pre- or post-plating changes are needed to the geometry of the piston 15 and/or block before use in the engine 10. It should be appreciated that the tubes 31 of the oil cooler 16 can also be coated by the electroless nickel or electrolytic processes as described above.

Referring specifically to FIG. 2, as the piston 15 reciprocates within the cylinder 14 between top dead center and bottom dead center, the coating 30 on the top surface of the piston 15 exposed to the combustion chamber 12 may burn due to the heat caused by the fuel combustion. Those skilled in the art will appreciate that the melting point of PTFE is 327° C. However, because the annular surface 22 of the piston 15 is not exposed to the combustion chamber 12 and there is coolant flowing through the cavity 28 of the piston 15, the heat from the combustion will not burn the coating 30 on the lands 24*a-d* and in the ring grooves 23*a-c* of the annular surface 22. Thus, when carbon produced by the combustion comes in contact with the coating 30 on the annular surface 33, the carbon will be repelled by the relatively low surface tension of the coating 30. Carbon has a higher surface tension than the electroless nickel-phosphorous PTFE coating 30. Because the carbon will not adhere to the piston lands 24*a-d*, carbon packing will not interfere with the oil flow along the piston-liner area 21. As the piston 15 moves from bottom dead center to top dead center, the rings 20 will move oil from the bottom of the piston-liner area 21 to the top of the piston-liner area 21, creating a thin surface of oil along the piston-liner area 21. Excess oil will not enter the combustion chamber 12. Further, because the carbon will not adhere to the ring grooves 23*a-c*, the tension between the piston rings 25*a-c* and the cylinder liner 13 will remain lesser affected by carbon deposits, allowing the piston rings 25*a-c* to move along the thin layer of oil as per design parameters. However, the movement of the piston rings 25*a-c* move against the liner 13 may cause limited movement, or lashing, of the rings 25*a-c* against the annular surface 22. Because the coating 30 includes the strength of the nickel matrix, the coating 30 will not be adversely affected by the limited movement, or lashing of the rings.

Referring specifically to FIG. 3, during operation of the engine 10, oil is being recirculated through the engine 10. As the oil passes through the engine 10, the oil absorbs heat from the working engine 10. In order to cool the recirculated oil, the oil is passed through the oil cooler 16. As the oil is passed over the bundle of tubes 31 coated with the relatively low surface tension coating 30, the carbon suspended in oil will be repelled, rather than adhere, to the coating 30. Thus, the oil will not leave carbon deposits that could affect the life of the tubes 31 and interfere with the thermal transfer between the coolant within the tubes 31 and the oil. The coolant within the tubes 31 will absorb the heat from the oil, thereby cooling the oil.

The present disclosure is advantageous because the coating 30 prevents adverse consequences of carbon packing, and deposits such as decreased fuel efficiency, shortened engine component life, and possible engine failure, without requiring expensive alterations to the engine 10. By coating the piston 15 and the coolant tubes 31 with the robust, relatively low surface tension coating 30, the carbon deposits are repelled from the non-contact wear surfaces 22 and 34 of the piston 15 and coolant tubes 31, respectively. The 18-28% of PTFE within the electroless nickel matrix is a compromise between low surface tension and structural integrity. The PTFE imparts its low surface tension into the coating 30 without affecting the bond strength of the nickel matrix which is required for the application of the coating 30 in the engine cylinder 14. The coating 30 can withstand the movement and load of the rings 25*a-c* against the annular surface 22 of the piston 15 as the piston 15 reciprocates. Moreover, the coating 30, as evidenced by its application in the oil cooler 16, can find application in a variety of environments. Further, because the total surface of the piston 15 is coated with the electroless nickel-phosphorous PTFE, the coating 30 can act as a low-friction coating for wear surfaces, such as a piston-pin contact area at the bottom of the piston 15, that it happens to cover. Overall, the engine life and performance may be improved by the carbon deposit resistant components without making major alterations to the engine 10.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. An engine including, at least one, carbon deposit resistant component, comprising:

an engine housing;

at least one engine component being at least one of attached to and positioned within the engine housing. and including at least one relatively high surface energy surface being a non-wear surface;

a relatively low surface energy coating adhered to the at least one relatively high surface energy surface of the engine component and having a surface energy at least one of equal to and less than 30 dynes/cm; and the relatively low surface energy coating includes nickel polytetrafluoroethylene.

2. The engine of claim 1 wherein the engine component includes at least one of a piston within a combustion chamber and at least one coolant tube of an oil cooler.

3. The engine of claim 1 wherein the relatively low surface energy coating includes electroless nickel phosphorous-polytetrafluoroethylene.

4. The engine of claim 3 wherein the electroless nickel phosphorous-polytetrafluoroethylene includes 10-33% polytetrafluoroethylene by volume.

5. The engine of claim 3 wherein the electroless nickel phosphorous-polytetrafluoroethylene includes 18-28% polytetrafluoroethylene by volume.

6. The engine of claim 5 wherein the engine component includes at least one coolant tube of an oil cooler; and the relatively high surface energy surface being an outer surface of the at least one coolant tube.

7. The engine of claim 5 wherein the engine component includes a piston within a combustion chamber, and the relatively high surface energy surface of the piston includes an annular side surface.

8. The engine of claim 7 wherein the coating being at least one of equal to and less than seven microns.

9. A method of reducing carbon deposits on at least one non-wear surface of an engine component, comprising a step of:

coating at least one relatively high surface energy surface of the engine component with a relatively low surface energy material that includes a surface energy at least one of equal to and less than 30 dynes/cm; and the relatively low surface energy material includes nickel polytetrafluoroethylene.

10. The method of claim 9 wherein the step of coating includes a step of applying the coating to a total surface of an engine piston in an electroless nickel bath.

11. The method of claim 9 wherein the step of coating includes a step of apply the coating to an engine piston in an electrolytic plating bath.

12. A carbon deposit resistant engine piston comprising:

a piston body including at least one relatively high surface energy surface being a non-wear surface;

a relatively low surface energy coating being attached to the at least one relatively high surface energy surface. and including a surface energy at least one of equal to and less than 30 dynes/cm;

the relatively low surface energy coating includes nickel polytetrafluoroethylene.

13. The engine piston of claim 12 wherein the relatively low surface energy coating includes electroless nickel phosphorous-polytetrafluoroethylene.

14. The engine piston of claim 13 wherein the electroless nickel phosphorous-polytetrafluoroethylene includes 18-28% of poly tetra fluoroethylene by volume.

15. The engine piston of claim 12 wherein the at least one relatively high surface energy surface includes an annular side surface.

16. The engine piston of claim 15 wherein the relatively low surface energy coating being at least one of equal to and less than seven microns.

17. The engine piston of claim 16 wherein the relatively low surface energy coating includes electroless nickel phosphorous-poly tetra fluoroethylene, and the electroless nickel phosphorous-polytetrafluoroethylene includes 18-28% of polytetrafluoroethylene by volume.

* * * * *

UNITED STATES PATENT AND TRADEMARK OFFICE

CERTIFICATE OF CORRECTION

PATENT NO. : 7,383,806 B2
APPLICATION NO. : 11/131743
DATED : June 10, 2008
INVENTOR(S) : Hind Abi-Akar It is certified that error appears in the above-identified patent and that said Letters Patent is hereby corrected as shown below:

Please correct the References Cited as follows:
Title Page, item (56), under "U.S. Patent Documents", in Column 1, Line 2, delete "3,592,370" and insert -- 3,552,370 --.

Title Page, item (56), under "U.S. Patent Documents", in Column 1, Line 2, delete "7/1971" and insert --1/1971 --.

Title Page, item (56), under "U.S. Patent Documents", in Column 1, Line 4, delete "4,666,788" and insert -- 4,666,786 --.

Title Page 2, item (56), under "Other Publications", in Column 2, Line 9, delete "Finshing" and insert -- Finishing --.

Please correct the Attorney, Agent, or Firm name as follows:
Title Page, item (74), under "Attorney, Agent, or Firm", in Column 2, Line 1, after "Liell" delete "+" and insert -- & --.

Please correct the Specification as follows:
Column 3, line 9, delete ""surface energy"." and insert -- "surface energy",--.

Please correct the Specification as follows:
Column 4, line 53, delete "cooper" and insert -- copper --.

Column 4, line 63, delete "cooper." and insert -- copper. --.

Signed and Sealed this

Twenty-fourth Day of February, 2009

JOHN DOLL
*Acting Director of the United States Patent and Trademark Office*